United States Patent [19]

Andersson

[11] 4,175,908

[45] Nov. 27, 1979

[54] METHOD OF LOADING AND UNLOADING HEAVY OBJECTS FROM A VESSEL

[75] Inventor: Bengt V. Andersson, Vesteras, Sweden

[73] Assignee: AB Resmastservice, Skovde, Sweden

[21] Appl. No.: 805,211

[22] Filed: Jun. 9, 1977

[30] Foreign Application Priority Data

Jun. 11, 1976 [SE] Sweden ..... 7606685

[51] Int. Cl.[2] ..... B65G 63/04

[52] U.S. Cl. ..... 414/786; 212/3 R; 414/139

[58] Field of Search ..... 214/12, 13, 14, 152, 214/38 CA; 212/3, 15; 114/63, 72, 258

[56] References Cited

U.S. PATENT DOCUMENTS

| | | | |
|---|---|---|---|
| 1,341,996 | 6/1920 | Plucienski | 214/38 CA |
| 1,531,075 | 3/1925 | Clubine | 214/38 CA |

FOREIGN PATENT DOCUMENTS

| | | | |
|---|---|---|---|
| 1034411 | 6/1966 | United Kingdom | 214/14 |

*Primary Examiner*—Stephen G. Kunin
*Assistant Examiner*—George F. Abraham
*Attorney, Agent, or Firm*—Pollock, Vande Sande & Priddy

[57] ABSTRACT

A method of loading and unloading a vessel with heavy objects whereby an object is vertically lifted, for instance from a vehicle drivable on a quay, by means of a crab, gantry or the like which together with said object is moved horizontally along girders from the lifting position to a position above the hold of the vessel. Said girders are arranged on the quay, extending in a cantilever manner out beyond the edge of the quay substantially up to the adjacent edge of the hold. From said cantilever girders the crab together with the object is moved over to and along horizontal extensions of said girders. These extensions, which are entirely supported by the vessel, bridge the hold. When the crab with the object has reached a suitable position on said extension and above the hold, the object is lowered into the hold. Also described is an equipment intended for carrying out said method into effect.

7 Claims, 1 Drawing Figure

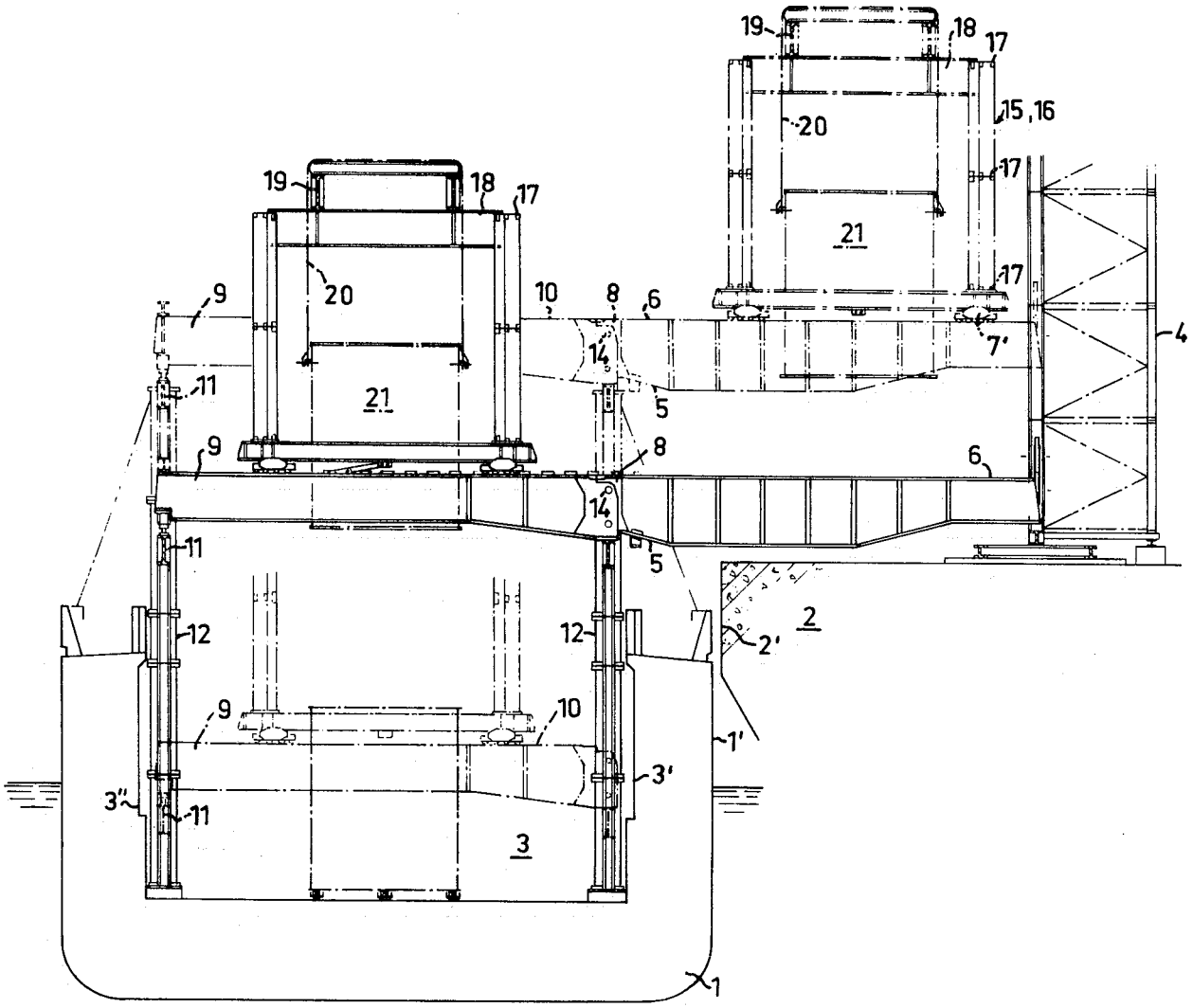
4
15,16
17
18
19
20
21
7'
6
5
8
14
10
9
11
12
2
2'
1'
1
3'
3
3''

METHOD OF LOADING AND UNLOADING HEAVY OBJECTS FROM A VESSEL

The transport of heavy objects on a vessel has hitherto been done by means of three different types of vessels or methods of loading and unloading, namely, (1) so-called "roll and roll-off", (2) vessels, vessels having their own crane equipment for loading and unloading heavy objects, and (3) harbor cranes or pontoon cranes. All these methods have serious disadvantages. Roll and roll-off vessels require specially designed harbor installations both at the loading locality and at the unloading locality, which limits the use of such vessels to fixed routes. Vessels provided with a crane equipment for handling heavy objects are very expensive, since the necessary crane equipment must be adapted to the heavy loads. Vessels constructed and equipped for the handling of heavy objects are also very few, so that the waiting time for a desired transport can be very long. Loading and unloading by means of harbour cranes or pontoons can only be accomplished in well-equipped harbors having heavy enough cranes, or at places close to such harbors where a pontoon crane can be sent.

Transport of heavy objects by means of vessels thus suffers from the disadvantages that said transport either must be made between definite, well-equipped harbors, which results in an extension of time and increase of costs for the overland transport to and from said harbors, or that special vessels must be used which are very costly and difficult to acquire.

The object of the present invention is to remove the above-mentioned disadvantages by the transport of heavy objects on vessels, and the invention relates to a method of loading heavy objects on a vessel of substantially conventional type for piece goods and to unload said objects from said vessel. The equipment used during loading and unloading can be stowed on the vessel, and can be erected at the load or unload harbor with the aid of the ordinary crane equipment on the vessel. The load and unload equipment may of course also form part of the harbor, and since it is comparatively simple and light, it does not require any especially great or expensive extensions or reinforcements of a normal harbor. By using the method of the invention, it is therefore possible, by means of a vessel for piece goods of comparatively normal type, to transport heavy objects between harbors or places which are not designed for loading and unloading of heavy objects.

The method according to the invention mainly comprises the following steps:

(1) The object to be loaded is lifted vertically by means of a crab, gantry crane or the like from a vehicle drivable along a quay; (2) the crab with the object is thereafter displaced horizontally from the lifting place to a position above the hold of the vessel along girders which are arranged on the quay and preferably extend out over the edge of the quay in a cantilever manner substantially up to the adjacent edge of the hold, and over to and along horizontal extensions of said girders, said extensions bridging the hold and being supported by the vessel, whereupon (3) the object is lowered into the hold.

Equipment suitable for carrying the inventive method into effect preferably comprises the following means:

(a) at least one support mast erectable on the quay opposite the hold of a vessel moored at said quay;

(b) a lifting yoke arranged for vertical movement along said support mast;

(c) a pair of girders mountable with one of their ends to said lifting yoke so that said griders extend in a cantilever manner from said support mast and out to the adjacent side of said moored vessel;

(d) a number of lifting masts pairwise erectable in a vertical position adjacent each side wall of the hold of said vessel;

(e) a horizontal support beam arranged between each lifting mast of the pair of lifting masts for vertical displacement upwards and downwards in said hold, each said support beam thereby maintaining its horizontal extension;

(f) a pair of girder sections mounted to said support beams for vertical displacement therewith into and out of alignment with said cantilever girders to form extensions thereof;

(g) said cantilever girders having plane horizontal top surfaces forming a runway for a crab for lifting a heavy object to be loaded and unloaded, said crab being movable along said runway and from the same over to plane horizontal top surfaces of said girder sections, when the same are displaced into alignment with said plane horizontal top surfaces of said cantilever girders.

The method of loading and unloading heavy objects according to the invention and equipment suitable for carrying said method into effect will be described in detail below under reference to the attached schematic drawing, which in elevation shows said equipment in three different working positions, together with a vessel in cross-section.

The FIGURE shows a vessel 1 of conventional type for transport of piece goods, said vessel being moored at a quay 2. The vessel is shown in cross-section through one of the holds 3 thereof.

At a distance inside the edge 2' of the quay 2 a pair of support masts 4 are arranged longitudinally beside each other opposite the opening to the hold 3. Each support mast 4 is rigidly anchored on the quay 2 and is provided with a lifting yoke or similar device which is displaceable upwards and downwards along said masts by the aid of suitable lifting means. The lifting yokes of the two masts 4 are interconnected by means of horizontal support beams which thus can be moved upwards and downwards between said masts 4 while retaining a horizontal position when said lifting yokes are displaced by said lifting means. At one of their ends a pair of rigid girders 6 having plane horizontal top surfaces are rigidly connected to said horizontal support beams between the masts 4. Said girders 5 extend in a cantilever manner towards and beyond the quay edge 2' and in over the adjacent vessel side 1' up to the wall 3' of the hold 3. The cantilever girders 5 are arranged mutually parallel and their plane horizontal top surfaces 6 form a runway for the rollers or wheel sets 7' of a crab 7, a gantry crane or the like which by means of roller or wheel sets is movable in both directions along the said girders 5. The free ends of the girders 5 are preferably supported at the vessel side 1' in a manner to be described below.

A pair of horizontal girder sections 9 having plane top surfaces 10 are so arranged that they bridge the opening to the hold 3. The grider sections 9 are supported in horizontal positions by means of horizontal support beams 11 which are arranged along the opposite side walls 3' and 3'', respectively, of the hold 3 and can be lifted and lowered along said side walls while maintaining their horizontal position. For this purpose the ends of the horizontal support beams 11 are supported by lifting devices which are attached to the ship's hull. In the embodiment shown said lifting devices comprise four lifting masts 12 which are arranged in pairs at the opposite side walls 3',3'' of the hold 3 and rest on the floor plate of said hold. By means of said four lifting devices or lifting masts 12 the horizontal support beams 11 and thus the girder sections 9, which together form a load platform, can be displaced upwards and downwards in the hold 3, said load platform thereby entirely being supported by the vessel. It is therefore possible to lift said load platform so that said girder sections 9 form extensions of the cantilever girders 5 and the plane top surfaces 6 and 10 of said girders 5 and 9, respectively, are aligned with each other so that said crab 7 may be rolled along the plane top surfaces 6 of said cantilever girders 5 over to the plane top surfaces 10 of said girder section 9. The ends of said girders 5 and 9, facing each other, may in this position be rigidly interconnected, for instance by means of retractable locking pegs 14 or the like. Said locking pegs 14 need not be dimensioned to withstand any great loads, since they mainly are intended to ascertain the alignment between said plane top surfaces 6 and 10. The crab 7, mentioned above, comprises two side frames 15,16 which are rigidly interconnected by means of a number of cross bars 17 or the like. Each of said two side frames 15,16 comprises two vertical beams, situated at opposite end edges, between which a lifting yoke or beam 18 is vertically movable. The roller or wheel sets 7', previously mentioned, are preferably provided at the lower ends of said vertical beams. The lifting yokes or beams 18 of said frames 15,16 are interconnected by means of two transverse lifting girders 19 which are attachable over flexible, depending links, straps, wires or the like 20 to the object 21 to be lifted. When a vessel by means of the method and the equipment according to the invention is to be loaded with heavy objects, the support masts 4 are first mounted in a suitable position on the quay 2, whereafter the lifting yokes of said masts 4 are interconnected by means of the horizontal beams to which said cantilever girders 5 are mounted in a horizontal position. At the same time the lifting masts 12, which preferably extend up over the deck of the vessel substantially to the same height as the support masts 4 and their horizontal support beams 11, are erected and mounted in the hold 3. The portions of said lifting masts 12, situated within the hold 3, and the support beams 11 may eventually be permanently arranged in the hold 3, in which case the lifting masts 12 are extended up over the deck by means of further portions which are connected to the top ends of the permanent portions in the hold. Finally the girder sections 9, which form extensions of said cantilever girders 5, are fastened to said horizontal support beams 11, whereafter the crab 7 is placed on the cantilever girder 5 so that it can be moved along said cantilever girders 5 out onto said girder sections 9, forming extensions thereof, when the same are positioned in alignment with the cantilever girders 5. The above-described mounting work can be undertaken using the crane equipment of the vessel, and portions of the apparatus according to the invention, which can be stowed on the vessel, are so constructed n a known manner that they can be joined rapidly. During loading, an object 21 to be loaded is advanced, for instance on a trailer, into a position beneath the inner end portions of the cantilever girders 5 adjacent the support masts 4 arranged on the quay 2, whereafter the crab 7 is moved along said cantilever girders 5 into a position centrally over the object 21. Should the top surface of said object 21 during said advancement be positioned above the bottom edge of the cantilever girders 5, said girders 5 are lifted along the support masts 4 until said object 21 can be advanced (this position is shown in broken lines at the right-hand end of the FIGURE), and the cantilever girders 5 may then be lowered to straddle said objects (this position is shown in full lines).

The object 21 is thereafter coupled to the lifting beams 18 of the crab 7 by means of links or straps 20 and is lifted from the trailer by means of said lifting beams 18 to such a height that the bottom edge of the object 21 can pass freely over the rail of the vessel. With the object 21 in this lifting position, the crab 7 is moved outwardly along said cantilever girders 5, whose free ends preferably rest on the adjacent side edge of the vessel or on the adjacent support beam 11. The free ends 8 of the cantilever girders 5 are connected to the adjacent ends of the girder sections 9 by means of the locking pegs 14. The plane top surfaces 10 of the girder sections 9 are thereby aligned with the plane top surfaces 6 of the cantilever girders 5, and said girder sections 9 are held in this position by means of the horizontal support beams 11 being moved along the lifting masts 12 into alignment with said cantilever girders 5.

From the cantilever girders 5 the crab 7 is moved over to said girder sections 9 and into a suitable position on the same. From this position the object 21 is to be lowered down into the hold 3 to rest on the floor thereof or on an already loaded object. If the distance between the base surface of the object 21 and the surface on which said object shall rest is small, the lowering can be performed entirely by means of the lifting beams 18 of the crab 7. Should said distance be greater, the locking pegs 14 are removed, whereafter the lifting platform, provided by said girder sections 9 and said horizontal support beams 11, is lowered into the hold 3 together with the crab 7 and the object 21 by lowering said load platform along the lifting masts 12 by means of the lifting devices arranged thereon (this position is shown in broken lines to the left of the FIGURE). The load platform 9,11 may be lowered so far down into the hold 3 that object 21 rests on the hold floor, or the last portion of the lowering movement may be performed by means of the lifting means of crab 7.

When the lift links 20 have been released from the object 21, the load platform 9,11 is returned to the position with the surfaces 6,10 in mutual alignment, whereafter said crab 7 is moved towards the support masts 4 to collect a new object 21, the locking pegs 14 being inserted beforehand to assure the alignment of said surfaces.

The unloading of the vessel is obviously done in the opposite order. When loading or unloading is completed, the equipment may be dismounted and stowed on the vessel for renewed mounting at the next port of call.

By means of the method and the equipment according to the invention, a great number of advantages are obtained. Thus the necessary equipment is comparatively cheap and is always available, since it is carried on board the vessel. The equipment may be mounted in most harbors, since it only requires a suitable mounting site for the support masts 4.

Since the free ends of the cantilever girders 5 preferably rest on the side edge of the vessel or on the support beams 11, and said girders are adjustable heightwise at the opposite ends, the level of said girders 5 may easily be adapted to variations in the draught of the vessel during loading and unloading, and also to variations of the water level, for instance caused by the tide. Any longer stoppages to adjust the equipment for different conditions during loading or unloading are thus not necessary, since said adjustment can be continuously performed by actuation of the different lifting means.

The aforesaid should indicate that the cantilever girders 5, which are rigidly supported at the inner ends where the main part of the load is taken up and only rest relatively lightly on the vessel at the opposite ends, form a loading bridge which is completely supported on shore and may easily be adjusted to a suitable level. The load platform, consisting of the girder sections 9 and the support beams 11, however, is mainly or completely supported by the vessel so that the load, when it is lowered into the hold, is totally independent of the shore. The locking pegs 14 are only intended to form means for ascertaining the alignment between the girder surfaces 6 and 10, and said pegs do not have any supporting function.

The lifting devices of the equipment may be of many different designs, for instance in the form of hydraulic jack means, wire or chain winches or the like. The device for stepwise lifting of heavy loads according to U.S. Pat. No. 3,881,687 has proven very suitable in masts 4 and 12 as well as in crab 7.

What I claim is:

1. A method of transferring a heavy object between a first station and a second station, said first station having a vertically stationary position while the vertical position of said second station is variable in response to the load thereon, said first and second stations having adjacent facing edges, said method comprising the steps of:

(a) transferring said object onto said first station on a movable support;

(b) lifting said object vertically from said support by means of a lifting means above said first station;

(c) moving said lifting means with said object horizontally in the direction of said second station along first support means extending in cantilever fashion horizontally over said first station beyond said edge thereof and substantially up to the adjacent edge of said second station;

(d) displacing into alignment with said first support means a second support means horizontally disposed above said second station, said second support means being mounted on said second station for vertical up-and-down movement with respect thereto;

(e) moving said lifting means with said object from said first support means onto said second support means to a position above said second station; and (f) lowering said object onto said second station.

2. A method according to claim 1, wherein said object is lowered onto said second station by means of said lifting means.

3. A method according to claim 1, wherein said object is lowered onto said second station by lowering cantilever extensions of said first support means, supported by said second station, together with said lifting means and said object while maintaining said cantilever extensions in horizontal position.

4. A method according to claim 1, wherein said cantilever extensions are lowered into and lifted from said second station by vertically displacing horizontal support beams arranged at opposite sides of said second station.

5. A method according to claim 4, wherein said horizontal support beams are vertically displaced along vertical lifting masts on which the ends of said beams are supported.

6. A method according to claim 1 wherein said first support means, while maintaining their horizontal position, are lifted upwards from and lowered downwards toward said first station, to permit alignment with said second support means.

7. A method according to claim 1, including interconnecting the facing ends of said first support means and said second support means after alignment thereof.

* * * * *